US007503857B2

(12) United States Patent
Kasashima et al.

(10) Patent No.: US 7,503,857 B2
(45) Date of Patent: Mar. 17, 2009

(54) GOLF BALL

(75) Inventors: Atsuki Kasashima, Chichibu (JP); Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 259 days.

(21) Appl. No.: 11/477,444

(22) Filed: Jun. 30, 2006

(65) Prior Publication Data

US 2008/0004137 A1 Jan. 3, 2008

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS 5,005,838 A 4/1991 Oka
5,536,013 A * 7/1996 Pocklington ..... 473/384
6,162,136 A * 12/2000 Aoyama ..... 473/383
7,250,012 B1 * 7/2007 Simonds et al. ..... 473/383
2004/0198536 A1 * 10/2004 Ohama et al. ..... 473/378

FOREIGN PATENT DOCUMENTS

JP 02-068077 A 3/1990
JP 2-295573 A 12/1990

* cited by examiner

*Primary Examiner*—Raeann Trimiew
(74) *Attorney, Agent, or Firm*—Sughrue Mion, PLLC

(57) ABSTRACT

The invention provides a golf ball having a surface on which are formed a plurality of dimples having a circular outer edge that defines the dimple contour. Each dimple has formed therein, near a portion inside the dimple, a raised region with a circular edge, and also has formed therein, between the circular edge of the raised region and the circular outer edge of the dimple, a ring-like wall having a curved cross-sectional shape. The raised region has a top face which is substantially flat, and a height which is at most 60% of the dimple depth from the circular outer edge to the deepest position on the ring-like wall. In this golf ball, the distance of travel can be increased due to an air resistance-decreasing effect and a lift-maintaining effect.

20 Claims, 3 Drawing Sheets

GOLF BALL

BACKGROUND OF THE INVENTION

The present invention relates to a golf ball which has numerous dimples formed on the surface thereof, and excellent flight characteristics when hit by any golfer, whether amateur or professional.

The thin layer of air that flows close to the surface of a golf ball in flight after being hit is called the boundary layer. In a ball without dimples, a stream of air that is free of turbulence forms at this boundary layer. However, when numerous dimples are formed on the surface of the ball, the stream of air at the surface of the ball during flight changes from laminar flow to turbulent flow, causing the airflow separation point to retreat and lowering the air resistance.

In addition, increasing the lift is known to be a major factor in lengthening the flight time of the ball and thus extending its distance of travel. Moreover, it is also known that forming relatively large dimples on the surface of the ball has the effect of maintaining the lift in the low-speed region of the golf ball trajectory after the ball has passed its highest point.

Hence, various dimple designs involving the arrangement of dimples and their shape and structure have hitherto been carried out.

However, the dimple designs developed up until now have been limited in the degree to which they extend the distance traveled by a golf ball. A desire has thus existed to carry out new and original dimple designs so as to further increase the distance traveled by the ball.

SUMMARY OF THE INVENTION

It is therefore an object of the present invention to provide a golf ball which further enhances the aerodynamic performance due to dimple effects, and can thereby increase the distance traveled by the ball.

The inventors have conducted extensive studies in order to achieve the above object. As a result, by setting out primarily to improve the aerodynamic performance of the ball due to dimple effects, both in the high-speed region of the trajectory just after the ball is played and also in the low-speed region after the ball has passed its highest point, the inventors have conceived of dimples having a cross-sectional shape designed for an optimal effect in each of these regions.

Specifically, the inventors have discovered that, in dimples having a circular outer edge that defines the dimple contour, by forming inside the dimple near a center portion thereof a raised region with a circular edge, by forming also, between the circular edge of the raised region and the circular outer edge of the dimple, a ring-like wall having a curved cross-sectional shape, by forming the raised region so as to have a top face that is flat, and by adjusting the height of the raised region so as to be at most 60% of the dimple depth (the depth from the circular outer edge to the deepest position on the ring-like wall), the dimples provide optimal effects both in the high-speed region just after the ball is hit and also in the low-speed region after the ball has passed its highest point.

Accordingly, the invention provides the following golf balls.

1. A golf ball comprising a ball surface on which are formed a plurality of dimples having a circular outer edge that defines the dimple contour, wherein each dimple has formed therein, near a center portion inside the dimple, a raised region with a circular edge, and also has formed therein, between the circular edge of the raised region and the circular outer edge of the dimple, a ring-like wall having a curved cross-sectional shape; and the raised region has a top face which is substantially flat and a height which is at most 60% of the dimple depth from the circular outer edge to the deepest position on the ring-like wall.

2. The golf ball of (1), wherein the total number of dimples is at least 250 but not more than 360, of which at least one-half are dimples with a diameter of at least 4.2 mm.

3. The golf ball of (1), wherein the top face of the raised region is circular and has a diameter that is from 30 to 70% the dimple diameter.

4. The golf ball of (1), wherein the circular edge of the raised region has an edge angle of 10 to 30 degrees, and the circular outer edge of the dimple has an edge angle of 10 to 30 degrees.

5. The golf ball of (1), wherein the raised region has a height which is at most 40% of the dimple depth from the circular outer edge to the deepest position on the ring-like wall.

BRIEF DESCRIPTION OF THE DIAGRAMS

DETAILED DESCRIPTION OF THE INVENTION

The golf ball of the invention is described more fully below in conjunction with the attached diagrams.

Figure 1:
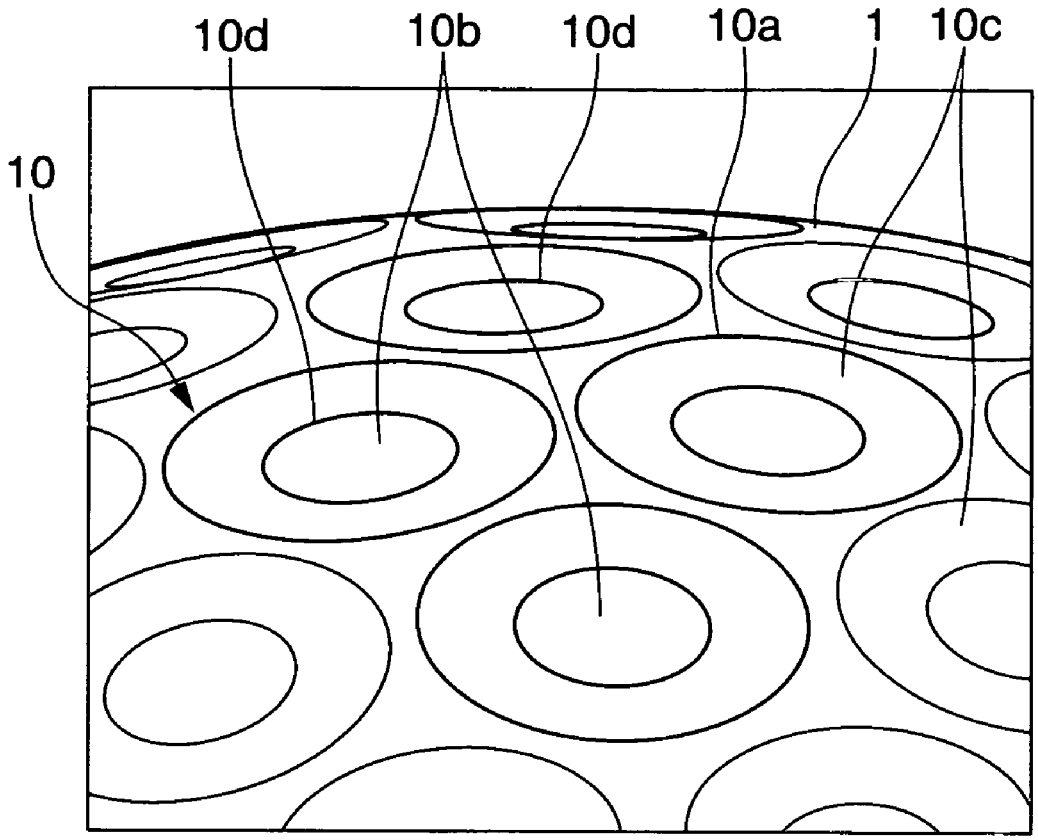
FIG. 1 is a partial perspective view of the surface of the golf ball of the invention.

Referring to FIG. 1, the golf ball of the invention has a plurality of dimples 10 formed on the ball surface. Each dimple 10 has an outer peripheral edge that is formed so as to be circular, which outer peripheral edge defines the dimple contour. This contour gives the surface of the ball, as seen in a planar view, a multi-circular pattern. This peripheral edge of the dimple is referred to below as the "circular outer edge 10*a*." A shape "in a planar view" refers herein to a contour shape as it appears in a flat plane when seen from directly above the ball. Inside the dimple 10, i.e., inside the circular outer edge 10*a*, a raised region 10*b* is formed at or near the center. This raised region 10*b* has a circular edge 10*d*. This circular edge 10*d* gives the surface of the ball a multi-circular pattern. Consequently, as shown in FIG. 1, the circular outer edge 10*a* of a dimples 10 and the circular edge 4*d* of the raised region 10*b* together provide a single dimple with a double circular contour.

Figure 3:
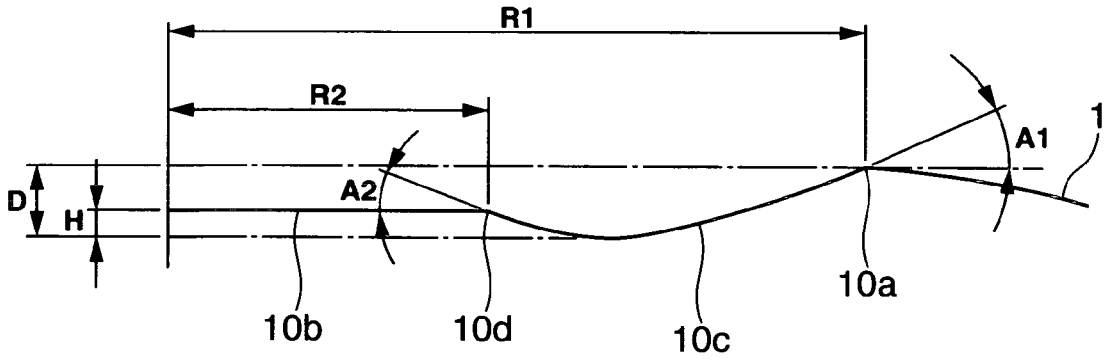
FIG. 3 is a diagram serving to explain the inside of the dimple shown in FIG. 2.

In the practice of the invention, a ring-like wall 10*c* having a curved cross-sectional shape is formed between the circular edge 10*a* of a dimple and the circular outer edge 10*d* of the raised region therein. As shown in FIG. 3, this ring-like wall 10*c* has, between the circular edge 10*a* of the dimple and the circular outer edge 10*d* of the raised region therein, a cross-sectional shape that traces a smooth arc and exhibits a ring-like shape in a planar view. In other words, this ring-like wall 10*c* has two peripheral edges—an inner peripheral edge and an outer peripheral edge. The inner peripheral edge coincides with the circular outer edge 10*d* of the raised region, and the outer peripheral edge coincides with the circular edge 10*a* of the dimple. The ring-like wall 10*c* has edge angles A1 and A2 at these two peripheral edges 10*a* and 10*d*, respectively. As illustrated in FIG. 3, each of these angles is represented by the angle, in the dimple cross-section, between a line segment which connects one edge of the dimple or raised region with the other edge thereof and the tangent to the curve (locus) at the respective peripheral edge. These edge angles A1 and A2 are preferably in a range of 10 to 45 degrees, and more preferably in a range of 10 to 30 degrees.

Figure 4:
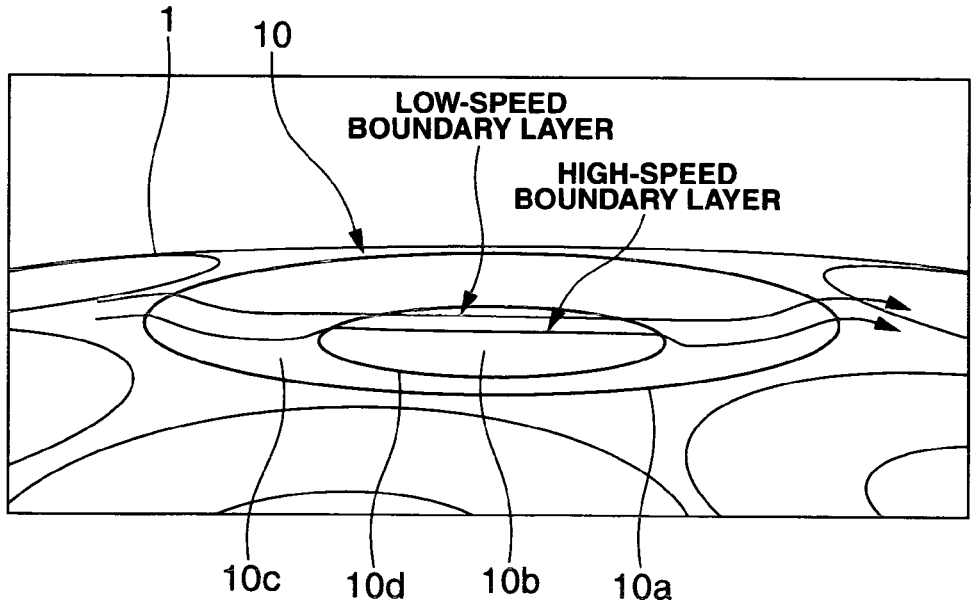
FIG. 4 illustrates the flow of air over the surface of the golf ball shown in FIG. 1.

In the invention, the ring-like wall 10*c* or the dimple 10 as a whole acts effectively to reduce air resistance and maintain lift. Briefly stated, this invention increases the distance traveled by a golf ball through the selective use of dimple effects that vary with differences in the boundary layer around the ball in the course of its trajectory; i.e., between the high-speed region just after the ball has been hit and the low-speed region after the ball has passed its highest point. That is, in the high-speed region just after the ball has been hit, because the boundary layer is thin, as shown in FIG. 4, the stream of air forms a high-speed boundary layer. As a result, the curved portion of the ring-like wall 10*c* acts as a dimple and is thus able to lower the air resistance.

In the low-speed region after the ball has passed the highest point of its trajectory, the boundary is thick. Hence, as shown in FIG. 4, the stream of air forms a low-speed boundary layer. As a result, the ring-like wall 10*c* exerts substantially no effect. Instead, the dimple 10 as a whole acts as a large dimple, thereby enabling lift to be maintained.

Figure 2:
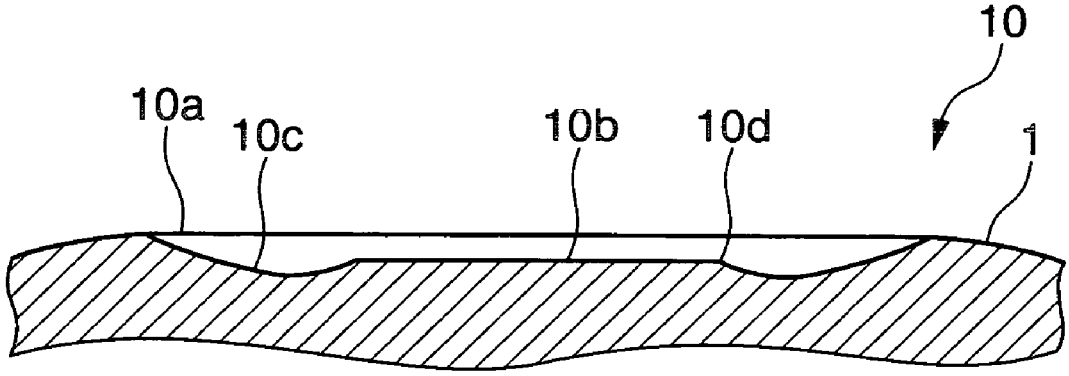
FIG. 2 is a cross-sectional view of a dimple according to the present invention.

As shown in FIG. 2, the raised region 10*b* has a top face that is substantially flat. Specifically, this top face, when viewed edge-on as shown in FIGS. 2 and 3, is either parallel to a straight line that horizontally connects the dimple edges, or is part of a circularly arcuate shape having a radius of at least 21 mm. The reason for this is that, given that the ball has a radius of generally about 21 mm, at a flatness of this degree, an effect due to the small dimple formed by the ring-like wall 10*c* is manifested in the high-speed region of the ball trajectory, and an effect due to the large dimple owing to the dimple as a whole is manifested in the low-speed region.

The top face of the raised region 10*b* has a circular shape with a radius which corresponds to R2 in FIG. 3. This radius R2 is preferably in a range of 30 to 70%, and more preferably in a range of 40 to 60%, of the radius R1 of the dimple. If this radius R2 is larger than the above range, the width of the ring-like wall 10*c* may become too narrow, preventing an aerodynamic performance by the ring-like wall from being effectively achieved. Conversely, if the radius R2 is too small, the effect owing to the larger dimple may be difficult to achieve.

As shown in FIG. 3, if D is the depth of the dimple 10 from the circular outer edge 10*a* thereof to the deepest position in the ring-like wall 10*c*, the height H of the raised region 10*b* is at most 60% of this depth D, and thus does not exceed the height of the circular outer edge 10*a* of the dimple. The height H of the raised region has an upper limit of preferably not more than 50%, and more preferably not more than 40%. If the raised region 10*b* is higher than the above range, the aerodynamic effect due to the large dimple 10 may not be sufficiently achieved in the low-speed region after the highest point on the ball's trajectory. The height H of the raised region preferably has a lower limit of at least 5%.

Concerning the types of dimple that may be used in the invention, all the dimples may be of one single type or a plurality of dimple types of differing diameter and/or depth may be used. "Dimple types" refers herein to dimples of differing diameter and/or depth. To illustrate, when three kinds of dimples with a large, medium or small diameter all have the same depth, the dimples are considered to be of three different types. By using dimples in a plurality of types, the dimples can be readily arranged to a high density and uniformity, thus making it possible to easily increase the dimple coverage on the surface of the ball. There is no particular upper limit on the number of dimple types used, although it is desirable for the number of dimple types to be from about 3 to 20.

As shown in FIG. 3, the diameter of the dimples that may be used in the invention is twice the dimple radius R1. This size is generally in a range of 2 to 7 mm, and preferably in a range of 2.5 to 6.0 mm.

The dimple depth is, as shown in FIG. 3, the depth D from the circular outer edge of the dimple to the deepest position of the ring-like wall. This depth is in a range of 0.05 to 0.15 mm, and is preferably set so as to be relatively shallow compared with the depth of an ordinary dimple such as is commonly used.

The total number of dimples (which refers to the total number of what are indicated in the diagram as dimples 10, and excludes the raised regions included therein) formed on the ball surface 1, while not subject to any particular limitation, is preferably at least 250, and more preferably at least 270, but preferably not more than 360, and more preferably not more than 340.

Moreover, in the present invention, inasmuch as the dimple effect is manifested by the ring-like wall, it is possible to effectively exhibit the advantages of the invention by arranging the dimples overall as a combination of relatively large dimples and a relatively small number of dimples (about 250 to 360)

The desired objects and advantages of the invention can be manifested if the dimples which include the above-described raised region and a ring-like wall account for at least 30%, and preferably at least 50%, of the total number of dimples formed on the surface of the ball.

Of the total number of the above dimples, it is preferable for at least one-half (at least 50%), and more preferably at least 70%, to have a dimple diameter of at least 4.2 mm.

Preferred examples of the pattern in which the dimples are arranged over the spherical surface of the ball include spherical icosahedral, spherical dodecahedral and spherical octahedral patterns. Examples of the units that may be used in such spherical polyhedral arrangements include unit polygons such as unit triangles and unit pentagons. That is, the dimples may be arranged according to a repeating pattern of such unit polygons on the above-described spherical polyhedron. Moreover, it is possible to vary the diameters of all the dimples by a small amount each.

Viewing the arrangement of dimples from directly above, the sum of the dimple surface areas as a ratio with respect to the total surface area of the golf ball, i.e., the planar surface area of each dimple circumscribed by the edge of the dimple, summed for all the dimples on the ball, as a ratio with respect to the surface area of the ball were it to have no dimples thereon, is preferably 70 to 89%.

The sum of the individual dimple volumes below a flat plane circumscribed by the edge of the respective dimple, is preferably at least 270 $mm^3$ but not more than 350 $mm^2$.

Because the dimples on the surface of the golf ball are formed on the outermost layer of the ball, when the cover that will serve as the outermost layer is injection molded, it is desirable to impress the numerous dimple shapes onto the surface at the same time that the cover is injection molded. To fabricate a mold (a two-part type mold) for this purpose, a technique may be employed in which, when dimples having the desired cross-sectional shape are to be formed on the surface of the ball, 3D CAD/CAM is used to directly cut an entire surface shape identical to the intended surface shape of the ball three-dimensionally into a master mold from which the golf ball mold is subsequently made by pattern reversal, or to directly cut three-dimensionally the inside walls of the cavity for the golf ball mold.

The surface of the ball may be administered any of various coatings in the same manner as in the prior art, such as a white enamel coating, an epoxy coating or a clear coating. In doing so, it is desirable for the coating to be carried out uniformly so as not to adversely affect the cross-sectional shape of the dimples.

The inventive golf ball is not subject to any particular limitation regarding the inner construction, and may be a solid golf ball such as a one-piece golf ball, a two-piece golf ball or a multi-piece golf ball of three or more layers, or may be a thread-wound golf ball. That is, the invention is applicable to all types of golf balls. For example, suitable use can be made of a multilayer construction having a resilient solid core, a cover, and one or more intermediate layer situated between the core and the cover. Ball specifications such as the ball weight and diameter may be suitably set in accordance with the Rules of Golf.

The invention is not limited to the dimple characteristics such as type, shape and size shown in the attached diagrams. Such dimple characteristics may be suitably selected insofar as they do not depart from the spirit and scope of the invention as described above.

EXAMPLES

Examples of the invention are given below by way of illustration, and not by way of limitation.

Example and Comparative Example

The balls used in the example of the invention and the comparative example had the same internal construction and materials. These balls had a construction composed of a resilient core of one layer, an intermediate layer, and a cover.

Resilient Core

The same resilient core composition was used in both the example of the invention and the comparative example. This composition is shown in Table 1 below.

TABLE 1

| Core formulation | |
|---|---|
| Polybutadiene BR730 | 100 |
| Zinc acrylate | 37 |
| Zinc oxide | 17.3 |
| Zinc stearate | 5 |
| Zinc salt of pentachlorothiophenol | 2 |
| Sulfur | 0.1 |
| 1,1-Bis(tert-butylperoxy)cyclohexane, 40% dilution | 3 |

Note:
Numbers in the table indicate parts by weight.

| | |
|---|---|
| Polybutadiene BR730: | Product of JSR Corporation |
| Zinc acrylate: | Product of Nihon Jyoryu Kogyo Co., Ltd. |
| Zinc oxide: | Product of Sakai Chemical Industry Co., Ltd. |
| Zinc stearate: | Product of NOF Corporation |
| Sulfur: | Product of Tsurumi Chemical Industry Co., Ltd. |
| 1,1-Bis(t-butylperoxy)cyclohexane, 40% dilution: | Product of NOF Corporation |

Cover and Intermediate Layer

In both the example of the invention and the comparative example, the cover material and intermediate layer material used were respectively a thermoplastic polyurethane elastomer and an ionomer resin. Table 2 shows the properties within the internal structures of these balls.

TABLE 2

| | | Example | Comparative Example |
|---|---|---|---|
| Resilient core | Radius (mm) | 18.65 | 18.65 |
| | Center hardness (JIS-C hardness) | 63.6 | 63.6 |
| | Outer surface hardness (JIS-C hardness) | 84.8 | 84.8 |
| | Surface hardness—center hardness (JIS-C hardness) | +21.2 | +21.2 |
| | Deflection (mm) | 2.89 | 2.89 |
| Intermediate layer | Material (ionomer resin) | | |
| | Thickness (mm) | 1.71 | 1.71 |
| | Shore D hardness | 64 | 64 |
| Cover | Material (thermoplastic polyurethane resin) | | |
| | Thickness (mm) | 0.99 | 0.99 |
| | Shore D hardness | 54 | 54 |

Deflection

The deflection (mm) by the core when placed on a hard plate and subjected to a final load of 1,275 N (130 kgf) from an initial load state of 98 N (10 kgf) was measured.

Shore D Hardness

Test specimens of the respective materials were prepared in sheet form, and measurements were carried out based on ASTM-D2240.

Figure 5:
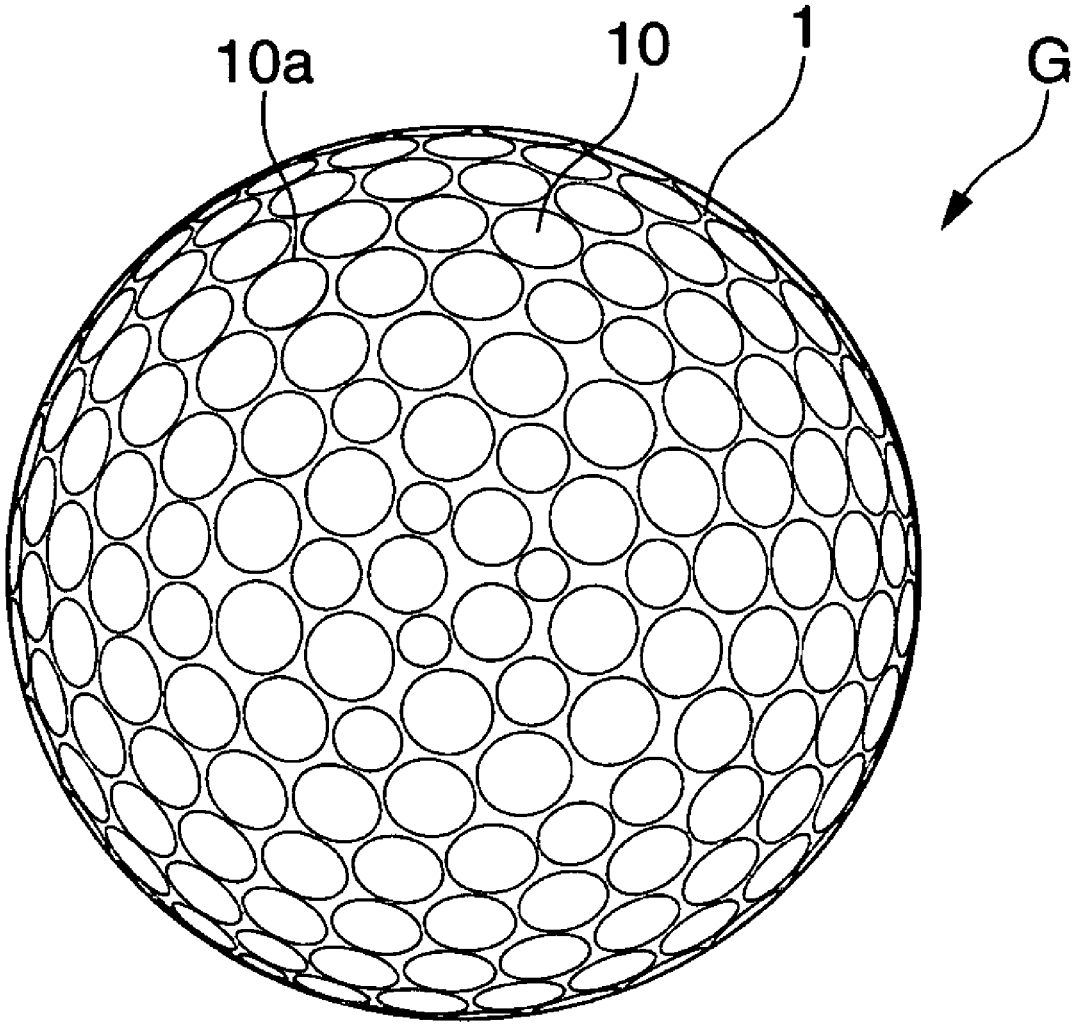
FIG. 5 is a front view showing the manner in which dimples are arranged on a ball surface used in an embodiment of the invention.

In both the example of the invention and the comparative example, a golf ball with the dimple arrangement shown in FIG. 5 was used and the dimples shown in Tables 3 and 4 below were designed. The dimple arrangement in FIG. 5 is based on an arrangement having 120° unit rotational symmetry in a hemisphere. In Table 3 below, which shows the dimples in the example of the invention, the symbols D, H, R1, R2, A1 and A2 correspond to the same symbols in FIG. 3.

TABLE 3

| Dimples in Example | | | | | | | | | |
|---|---|---|---|---|---|---|---|---|---|
| I | Number | Diameter (mm) | R2/R1 | Edge angle A1 · A2 | Depth D (mm) | Height H (mm) | H/D | Surface coverage (%) | Total volume ($mm^3$) |
| 1 | 12 | 2.5 | 0.5 | 20° | 0.1 | 0.02 | 0.20 | 81 | 310 |
| 2 | 12 | 3.5 | | | 0.11 | 0.02 | 0.18 | | |
| 3 | 60 | 3.8 | | | 0.12 | 0.03 | 0.25 | | |
| 4 | 234 | 4.4 | | | 0.12 | 0.03 | 0.25 | | |
| 5 | 12 | 4.6 | | | 0.12 | 0.03 | 0.25 | | |
| Total | 330 | | | | | | | | |

| Explanation of Terms in Table | |
|---|---|
| Diameter: | Diameter of flat plane circumscribed by outside edge of dimple (twice the symbol R1 in FIG. 3). |
| Depth (D): | Depth of dimple from circular outer edge to deepest position in ring-like wall (maximum dimple depth) |
| Height (H): | Height from dimple depth (D) to top face of raised region. |
| Edge angles (A1, A2): | Angle between line segment joining both peripheral edges of dimple or raised region and tangent to curve at peripheral edge of dimple or raised region. |
| Surface coverage: | Sum of individual dimple surface areas defined by border of flat plane circumscribed by edge of respective dimple, as a ratio to spherical surface area of ball were it to have no dimples thereon. |
| Total surface area: | Sum of individual dimple volumes formed below flat plane circumscribed by edge of respective dimple. |

TABLE 4

| Dimples in Comparative Example | | | | | | |
|---|---|---|---|---|---|---|
| I | Number | Diameter (mm) | Depth D (mm) | Cross-sectional shape | Surface coverage (%) | Total volume ($mm^3$) |
| 1 | 12 | 2.5 | 0.1 | close to circular arcuate | 81 | 315 |
| 2 | 12 | 3.5 | 0.13 | | | |
| 3 | 60 | 3.8 | 0.13 | | | |
| 4 | 234 | 4.4 | 0.14 | | | |
| 5 | 12 | 4.6 | 0.14 | | | |
| Total | 330 | | | | | |

| Explanation of Terms in Table | |
|---|---|
| Dimple diameter: | Same as above. |
| Dimple depth: | Depth from peripheral edge of dimple to deepest portion of dimple. |
| Surface coverage: | Same as above. |
| Total volume: | Same as above. |

Golf balls on the surface of which the dimples in the above-described example of the invention and the comparative example had been formed were measured for distance of travel according to the following criteria. The results are given in Table 5.

Flight Performance

The total distance traveled by the ball when hit at a head speed (HS) of 45 m/s with a driver (X-Drive Type 300 Prospec, manufactured by Bridgestone Sports Co., Ltd.; loft angle, 10°) mounted on a swing robot (Miyamae Co., Ltd.) was measured.

TABLE 5

| Distance | Example | Comparative Example |
|---|---|---|
| Carry (m) | 218 | 218 |
| Total distance (m) | 235 | 232 |

As explained above, the golf ball of the invention, owing to the special dimple inner surface shape described above, and owing also to the differing dimple effects in the high-speed region of the ball trajectory just after the ball has been hit and the low-speed region of the trajectory after the ball has passed its highest point, incurs an air resistance lowering effect and a lift maintaining effect which can increase the distance traveled by the ball.

The invention claimed is:

1. A golf ball comprising a ball surface on which are formed a plurality of dimples having a circular outer edge that defines the dimple contour, wherein each of the dimples has formed therein, near a center portion inside the dimple, a raised region with a circular edge, and also has formed therein, adjoining the circular edge of the raised region and the circular outer edge of the dimple, a ring-like wall having a curved cross-sectional shape; and the raised region has a top face which is substantially flat and a height which is at most 60% of the dimple depth from the circular outer edge to the deepest position on the ring-like wall.

2. The golf ball of claim 1, wherein the total number of dimples is at least 250 but not more than 360, of which at least one-half are dimples with a diameter of at least 4.2 mm.

3. The golf ball of claim 1, wherein the top face of the raised region is circular and has a diameter that is from 30 to 70% the dimple diameter.

4. The golf ball of claim 1, wherein the circular edge of the raised region has an edge angle of 10 to 30 degrees, and the circular outer edge of the dimple has an edge angle of 10 to 30 degrees.

5. The golf ball of claim 1, wherein the raised region has a height which is at most 40% of the dimple depth from the circular outer edge to the deepest position on the ring-like wall.

6. The golf ball of claim 1, wherein the top face of the raised region is parallel to a straight line that horizontally connects the dimple edges.

7. The golf ball of claim 1, wherein the top face of the raised region is part of a circularly arcuate shape having a radius of at least 21 mm.

8. The golf ball of claim 1, wherein the number of dimple types of differing diameter and/or depth are from 3 to 20.

9. The golf ball of claim 1, wherein the depth from the circular outer edge of the dimple to the deepest position of the ring-like wall is in a range of 0.05 to 0.15 mm.

10. The golf ball of claim 1, wherein the dimples having the raised region and the ring-like wall account for at least 30% of the total number of dimples formed on the surface of the ball.

11. The golf ball of claim 1, wherein at least one-half of the total number of the dimples formed on the surface of the ball have a dimple diameter of at least 4.2 mm.

12. The golf ball of claim 1, wherein the sum of the individual dimple volumes below a flat plane circumscribed by the edge of the respective dimple is from 270 to 350 $mm^3$.

13. A golf ball comprising a ball surface on which are formed a plurality of dimples having a circular outer edge that defines the dimple contour, wherein each of the dimples has formed therein, near a center portion inside the dimple, a raised region with a circular edge, and also has formed therein, between the circular edge of the raised region and the circular outer edge of the dimple, a ring-like wall having a curved cross-sectional shape that traces a smooth arc and exhibits a ring-like shape in a planar view and the ring-like wall having two peripheral edges of an inner peripheral edge and an outer peripheral edge where the inner peripheral edge coincides with the circular edge of the raised region and the outer peripheral edge coincides with the circular outer edge of the dimple; and the raised region has a top face which is substantially flat and a height which is at most 60% of the dimple depth from the circular outer edge to the deepest position on the ring-like wall.

14. The golf ball of claim 13, wherein the top face of the raised region is parallel to a straight line that horizontally connects the dimple edges.

15. The golf ball of claim 13, wherein the top face of the raised region is part of a circularly arcuate shape having a radius of at least 21 mm.

16. The golf ball of claim 13, wherein the number of dimple types of differing diameter and/or depth are from 3 to 20.

17. The golf ball of claim 13, wherein the depth from the circular outer edge of the dimple to the deepest position of the ring-like wall is in a range of 0.05 to 0.15 mm.

18. The golf ball of claim 13, wherein the dimples having the raised region and the ring-like wall account for at least 30% of the total number of dimples formed on the surface of the ball.

19. The golf ball of claim 13, wherein at least one-half of the total number of the dimples formed on the surface of the ball have a dimple diameter of at least 4.2 mm.

20. The golf ball of claim 13, wherein the sum of the individual dimple volumes below a flat plane circumscribed by the edge of the respective dimple is from 270 to 350 $mm^3$.

* * * * *